US008365979B2

(12) United States Patent
Messmer et al.

(10) Patent No.: US 8,365,979 B2
(45) Date of Patent: Feb. 5, 2013

(54) TAMPER EVIDENT LABEL

(75) Inventors: Michael J. Messmer, Toledo, OH (US); Michael W. Manahan, Bowling Green, OH (US)

(73) Assignee: Novavision, Inc., Bowling Green, OH (US)

( * ) Notice: Subject to any disclaimer, the term of this patent is extended or adjusted under 35 U.S.C. 154(b) by 608 days.

(21) Appl. No.: 12/590,406

(22) Filed: Nov. 6, 2009

(65) Prior Publication Data

US 2010/0181371 A1 Jul. 22, 2010

Related U.S. Application Data

(60) Provisional application No. 61/198,930, filed on Nov. 10, 2008, provisional application No. 61/269,055, filed on Jun. 19, 2009.

(51) Int. Cl.
*B65D 43/22* (2006.01)

(52) U.S. Cl. ..... 229/102; 206/807; 229/125.39; 428/42.1; 428/343

(58) Field of Classification Search ..... 229/102, 229/125.37, 125.39; 206/807
See application file for complete search history.

(56) References Cited

U.S. PATENT DOCUMENTS

| | | | | |
|---|---|---|---|---|
| 286,654 | A * | 10/1883 | Tobias | 229/125.37 |
| 1,472,381 | A * | 10/1923 | Bangs | 229/125.37 |
| 2,013,299 | A * | 9/1935 | Byrne | 229/102 |
| 5,082,702 | A * | 1/1992 | Alband | 428/41.5 |
| 5,506,015 | A * | 4/1996 | Frederiksen et al. | 428/41.8 |
| 5,866,183 | A * | 2/1999 | Small | 206/807 |
| 6,343,695 | B1 * | 2/2002 | Petrick et al. | 206/807 |
| 7,170,409 | B2 | 1/2007 | Ehrensvärd et al. | |
| 7,317,401 | B2 | 1/2008 | Germann et al. | |
| 7,448,153 | B2 | 11/2008 | Maliner et al. | |
| 7,475,788 | B2 | 1/2009 | Schwarz | |
| 7,497,379 | B2 | 3/2009 | Chen et al. | |
| 2005/0045503 | A1 * | 3/2005 | Wong et al. | 206/807 |
| 2006/0022027 | A1 * | 2/2006 | Grebinski | 229/125.37 |

FOREIGN PATENT DOCUMENTS

| | | | | |
|---|---|---|---|---|
| JP | 3-289465 | A * | 12/1991 | 206/807 |

* cited by examiner

*Primary Examiner* — Gary Elkins
(74) *Attorney, Agent, or Firm* — Emch, Schaffer, Schaub & Procello Co., LPA

(57) ABSTRACT

A tamper-evident label for a carton having one flap or two opposing flaps includes a pair of end portions each having adhesive or other means for fastening to span the edge of one flap or opposing flaps of the carton. A central area between the end portions defines one or more strips which overlie an edge of one or both flaps. The central area defining the strips is unadhereable to the flaps and are in a condition such that, upon cutting therethrough to form ends on said strips, the ends will be displaced from the strip ends on the opposite sides of the cut.

18 Claims, 18 Drawing Sheets

TAMPER EVIDENT LABEL

CROSS REFERENCE TO RELATED APPLICATIONS

This application is based upon and claims the benefit of U.S. provisional patent applications Nos. 61/198,930; filed Nov. 10, 2008; and 61/269,055; filed Jun. 19, 2009.

BACKGROUND OF THE INVENTION

Conventional security labels show tampering with a patterned release to show a hidden word (OPENED, VOID, etc.). Another common design is to use tamper slits or a frangible material, so the security label cannot be removed in one piece; instead it will break into multiple pieces when removed.

Both of the above features are effective if the label is removed. However, if the conventional security label is slit with a knife, the conventional designs do not readily indicate tampering. For example, on a shipping carton, the entire taped seam can be slit to gain access to the contents. In this case, the opposing carton flaps can be repositioned and retaped with clear packing tape.

It is also possible to partially slit the carton seam, remove some of the contents and then re-tape the carton seam. No re-positioning of the flaps is needed, thus making the intrusion harder to detect.

SUMMARY OF THE INVENTION

The present invention is directed to a tamper evident label and more specifically to a label for alerting an observer that flaps of a carton, corrugated or paperboard for example, have been opened or otherwise tampered with. The tamper evident label includes a pair of pads, each of which is to be joined to a separate flap of two adjacent flaps of a paper board or corrugated carton. The pads are joined together by one or more strips of material which are not adhered to the flaps of the carton but rather are twisted, bent or otherwise manipulated to place stress therein such that, if someone slits the carton in the area of the adjoining edges of the respective carton flaps or slits tape extending along such adjacent edges, the device cutting such tape or otherwise releasing the flaps from the adjoined position of such edges, will cut or otherwise sever the strip or strips extending between such pads. Since the strip or strips have been twisted or otherwise manipulated to provide stress therein, one end of the cut or otherwise severed strip will be displaced in relation to the opposing cut end, thereby revealing to an observer that there has been tampering of the label and the carton.

Under another embodiment the tamper evident label includes a security label having opposing ends which are to be adhered to adjacent flaps of a paper board or corrugated carton and a central portion which overlies the joint formed by the edges of the flaps but is not adhered to the flaps. The central portion is die cut to form a plurality of tamper strips which will be dislodged upon slitting or cutting along the joint. A protective shield overlies the security label. If someone slits the carton in the area of the adjoining edges of the respective carton flaps or slits tape extending along such adjacent edges, the device cutting such tape or otherwise releasing the flaps from the adjoined position of such edges, will cut or otherwise sever the tamper strips thereby causing the cut ends of the tamper strips to be displaced. Such displacement may be readily seen to alert the observer that tampering has occurred.

When the label is applied to flaps of a carton, the tamper strips will be only partially supported and not adhered to the flaps. When cut, the unsupported portions of the tamper strips will no longer be aligned as originally installed, which will indicate tampering.

The material of construction for the security label and/or protective shield is a plastic (polyester, polypropylene, polyethylene, etc.) paper (natural or synthetic), metal (aluminum, stainless steel, galvanized steel, etc.), fiberglass, or a combination of these materials.

The tamper strips may be any shape where one end is supported and the other end is not supported.

The device may include anti-counterfeiting technology for added security (holographic elements, taggants, serial numbers, hidden inks, etc.). These technologies may be used individually or in any combination.

The tamper strips may be protected by a translucent or transparent overlay (protective shield) to protect the strips from breaking with accidental handling abuse. The protective shield may be constructed with partial adhesive.

The tamper strips may also be reinforced with special materials to make the strips more durable to prevent breaking.

If desired, additional security features may be added to the label including holographic elements, serial numbers, taggants, hidden inks and the like. In addition to being attached to the flaps by adhesive, tamper evident labels could be attached by mechanical fasteners such as screws, pop rivets, staples, brads and the like.

The label may have any desired shape as long as it has a minimum of two areas with adhesive for attaching to opposing flaps of a carton.

Objects and advantages of the present invention will become apparent to those skilled in the art upon a review of the following detailed description of the preferred embodiments and the accompanying drawings.

DETAILED DESCRIPTION OF THE INVENTION

Figure 1A:
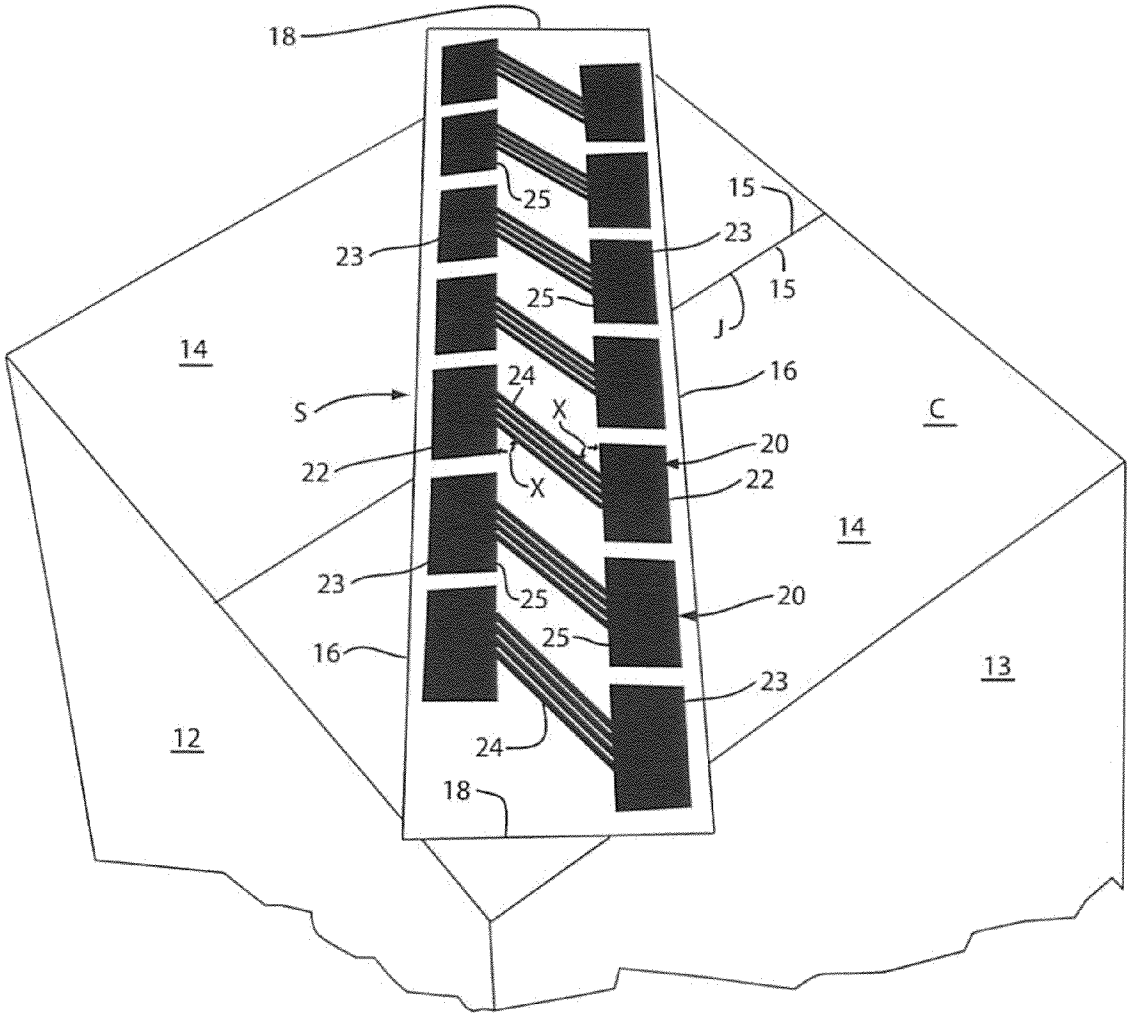
FIG. 1*a* is a perspective view showing a sheet on which are mounted a plurality of labels stamped from a sheet of label material with the mounting sheet, positioned over a corrugated carton.

Referring to the drawings, there is shown in FIG. 1*a* a mounting sheet S supporting a plurality of tamper evident labels 20 of the present invention. The mounting sheet S is shown resting upon a corrugated carton C having sidewalls 12 and a pair of end walls 13 extending between the sidewalls 12. Extending from each of the end walls 13 are a pair of flaps 14 which, when folded form the top or bottom of the carton C. Each flap has an edge 15. As shown in FIG. 1, the edges 15 meet in abutting relationship and define a joint J which may be sealed by tape extending across the flaps 14 on opposite sides of the respective edges 15. Alternatively, one flap may be adhesively secured to an underlying flap extending from the sidewalls 12. Additionally, frequently the edges 15 of the flaps 14 will be in slightly spaced relationship with one another and, in some constructions, the edge 15 of one flap 14 may extend beyond the edge 15 of the opposing flap and overlie a portion of the opposing flap 14. The tamper evident label 20 of the present invention is suitable for a carton C whether the edges 15 are in abutting relationship as shown in FIG. 1*a* or have a slight gap therebetween (one eighth-inch to three-eighth inch, for example) and for a carton in which the edge 15 of one flap 14 overlies the edge 15 of the opposing flap 14.

Figure 1B:
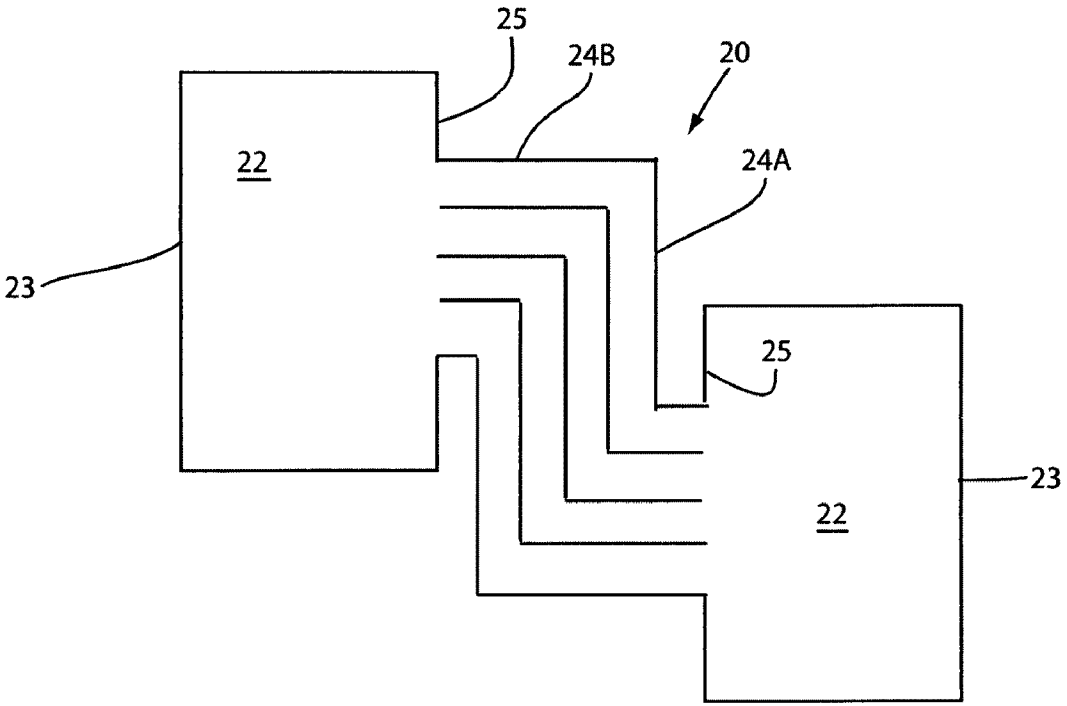
FIG. 1*b* is a drawing showing another embodiment of tamper evident label.

As shown in FIG. 1*a*, the mounting sheet S has a rectangular shape with a pair of parallel long edges 16 and a pair of end edges 18 disposed perpendicular to the long edges 16. Mounted on the sheet S are a plurality of tamper evident labels 20 of the present invention which had been die cut or stamped from a web of label material of a type hereinafter set forth. The tamper evident labels 20 each has a pair of pads 22 joined together by a strip or strips 24. Each of the pads 22 has an outer edge 23 and an inner edge 25 with the strip 24 of each label 20 extending from the opposed inner edges 25. The tamper evident labels 20 are preferably cut with the pads 22 offset from one another such that the strip or strips 24 of each label is/are disposed at an angle X in the range of 10° to 80° relative to the respective inner edges 25. Additionally, it is within the contemplation of the present invention that the labels 20 could be die cut as shown in FIG. 1*b* such that strip or strips 24 have a first section 24A substantially parallel (i.e. at 0° relative to) the inner edge 25 of the first pad 22 and a second section 24B substantially perpendicular to the inner edge 25 of the opposing pad 22. In this way, some stress will be imparted to the strips 24 by fastening one of the pads 22 to a flap 14 such that the inner edge 25 of the first pad 22 is parallel to the edge 15 and then moving the second pad 22 to a position at which the strip first section 24A is nearly perpendicular to the joint J prior to adhering the second tab 22 to the opposing flap 14. The surface of each pad 22 facing a flap 14 has pressure sensitive adhesive; however, the strips 24, 24A and 24B do not.

Figure 2:
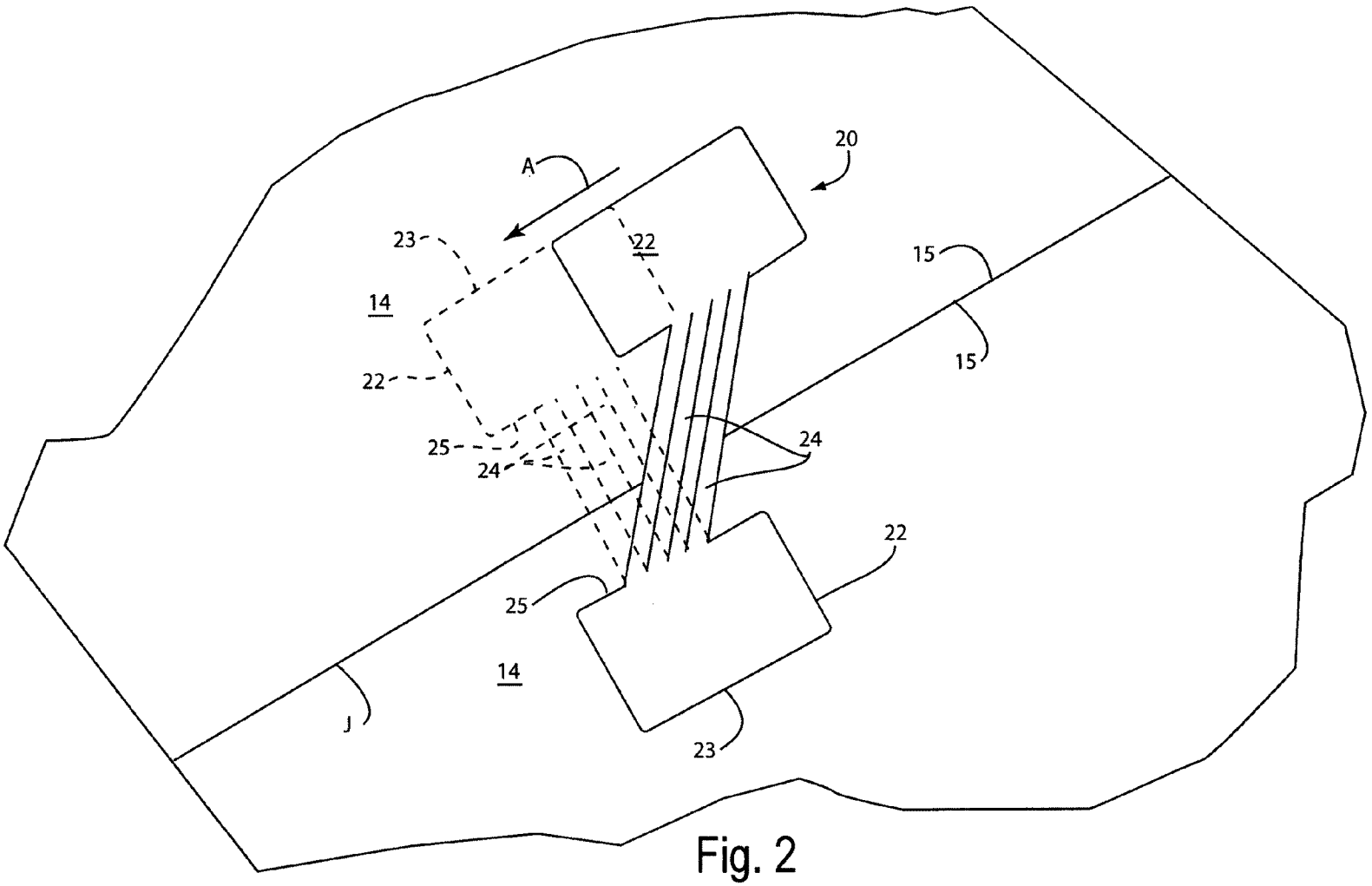
FIG. 2 is a perspective view showing the tamper evident label of FIG. 1*a* with one of its pads adhered to one flap of a carton and the other pad, attached to the first pad by a strip, about to be adhered to an adjacent flap of the carton.

Referring to FIG. 2 there is shown the tamper evident label 20 of the present invention being affixed to opposing flaps 14 of a carton. The tamper evident label 20 includes a pair of anchoring pads 22 joined together by one or more tamper evident strips 24. The tamper evident strips are pre-stressed prior to affixing the pad 22 to its respective flap 14.

For example, FIG. 2 shows the steps of affixing the tamper evident label 20 of FIG. 1*a* to the flaps 14 of a carton. Initially one pad 22 is adhered to one flap 14 with its inner edge 25 substantially parallel to the joint J. As can be seen from FIG. 2, the opposing pad 22 is then moved in the direction indicated by arrow A to a position shown by dashed lines in FIG. 2 and then adhered to its respective flap 14. When affixed to the flap 14 following such movement, the tamper evident strips 24 will be nearly perpendicular to the joint J and will be pre-stressed as a result of such movement.

As a result of being pre-stressed, the strip or strips 24 are, in effect, spring loaded, so that, when such strip or strips 24 are cut, for example by someone cutting the tape T overlying the adjacent edges 15 and adjacent portions of the flaps 14, the cut ends 26 (FIG. 4) of the severed strips 24A will be displaced from one another, thereby rendering obvious the tampering from unauthorized access to the carton C. As previously mentioned, the strip or strips are not adhered to the flaps 14, only the pads 22 are adhered. Although adhesive is preferred for securing the pads 22 to the respective flaps, other types of fasteners could be used including, for example, screws, pop rivets, staples and brads. If adhesive is used, it could be patterned.

Figure 3:
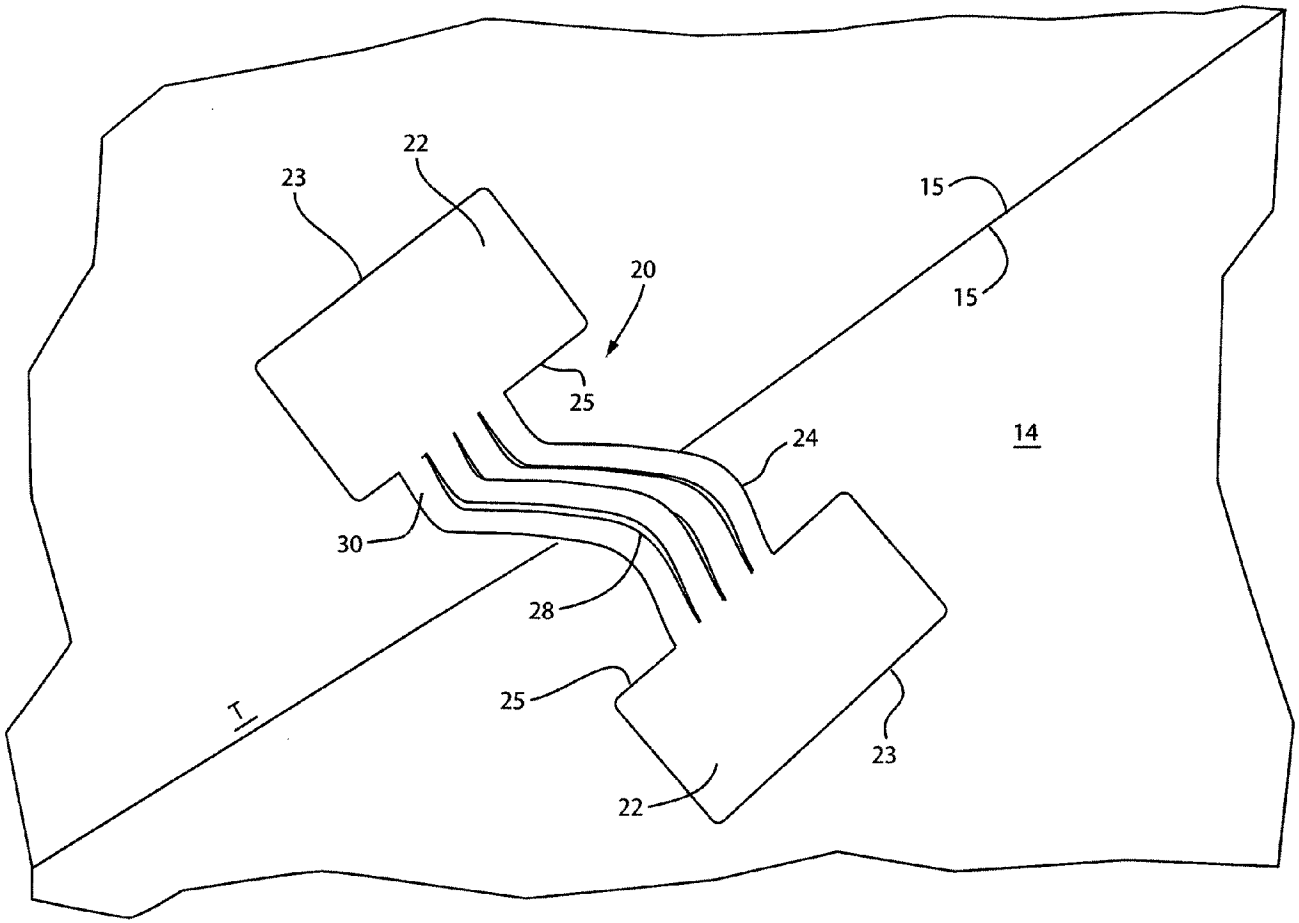
FIG. 3 is a view showing both pads adhered to the adjoined flap of the carton with the strips deformed to provide an upwardly facing concavity and an upwardly facing convexity.

The pre-stressing of the strip or strips 24 adjoining the opposing pads 22 may be accomplished by bending the strip or strips 24 as shown in FIG. 3 to define for example, an upwardly facing convexity 28 adjacent one of the pads 22 and an upwardly facing concavity 30 adjacent the opposing pad 22.

Figure 5:
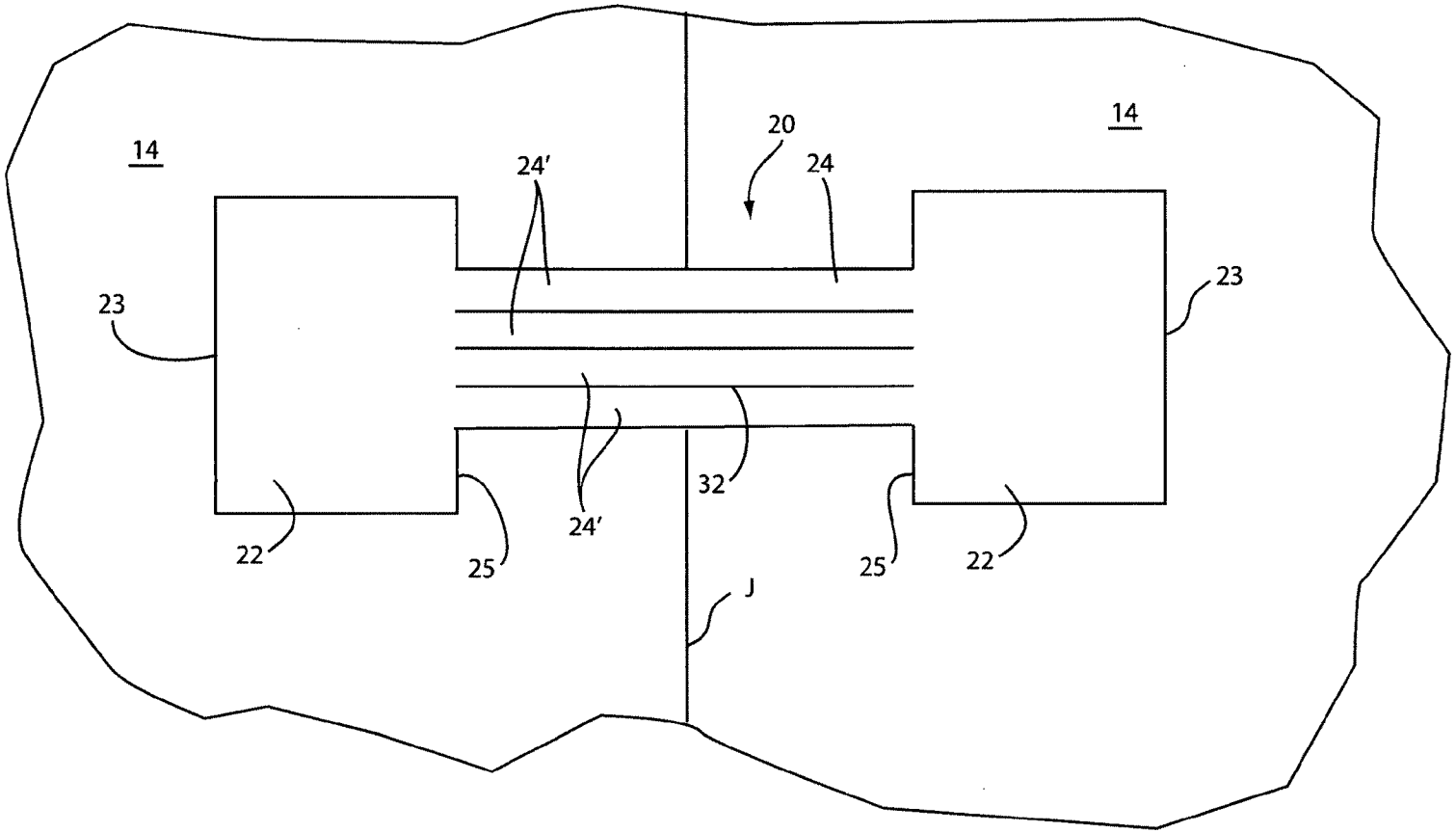
FIGS. 5 and 6 are views showing a series of manipulative steps in which the tamper evident label initially has one of its pads adhered adjacent the edge of one flap of a carton (FIG. 5) and then the other pad is twisted 360 degrees (FIG. 6) and when so twisted is adhered to the opposing flap.

The tamper evident label 20 can be manufactured from a number of types of material provided such material, upon deformation from its "as-manufactured state", will have imparted thereto stresses which, upon severing of such strip or strips 24 following application of the pads 22 to flaps 14 of a carton, will cause the ends 26 of the cut strips 24A to be displaced from the ends 26 of the cut strips 24A extending from the opposing pad 22 (see FIG. 5). Suitable materials having a characteristic of building up of stresses in the strip or strips 24 upon deformation including a wide variety of plastics such as polyester, polypropylene, and polyethylene, natural or synthetic paper, fiberglass reinforced plastics and metal such as aluminum, stainless steel, galvanized steel or other metals.

The tamper evident label 20 should have a thickness in the range of 0.0003 to 0.030 inches (0.3 mils to 30 mils) such that it can be readily deformed but also easily cut with a knife or other sharp tool.

Referring to FIG. 5 there is shown a tamper evident label 20 as manufactured and cut from a sheet of label material. As can be seen the opposing pads 22 are joined by a strip 24 which, during the stamping process has had a plurality of cuts 32 made so that the strip 24 defines a plurality of narrow strips 24' each of which is joined to the opposing pads 22. The label 20 is shown resting upon the flaps 14 with only one of the tabs 22 adhered to its underlying flap 14.

Figure 4:
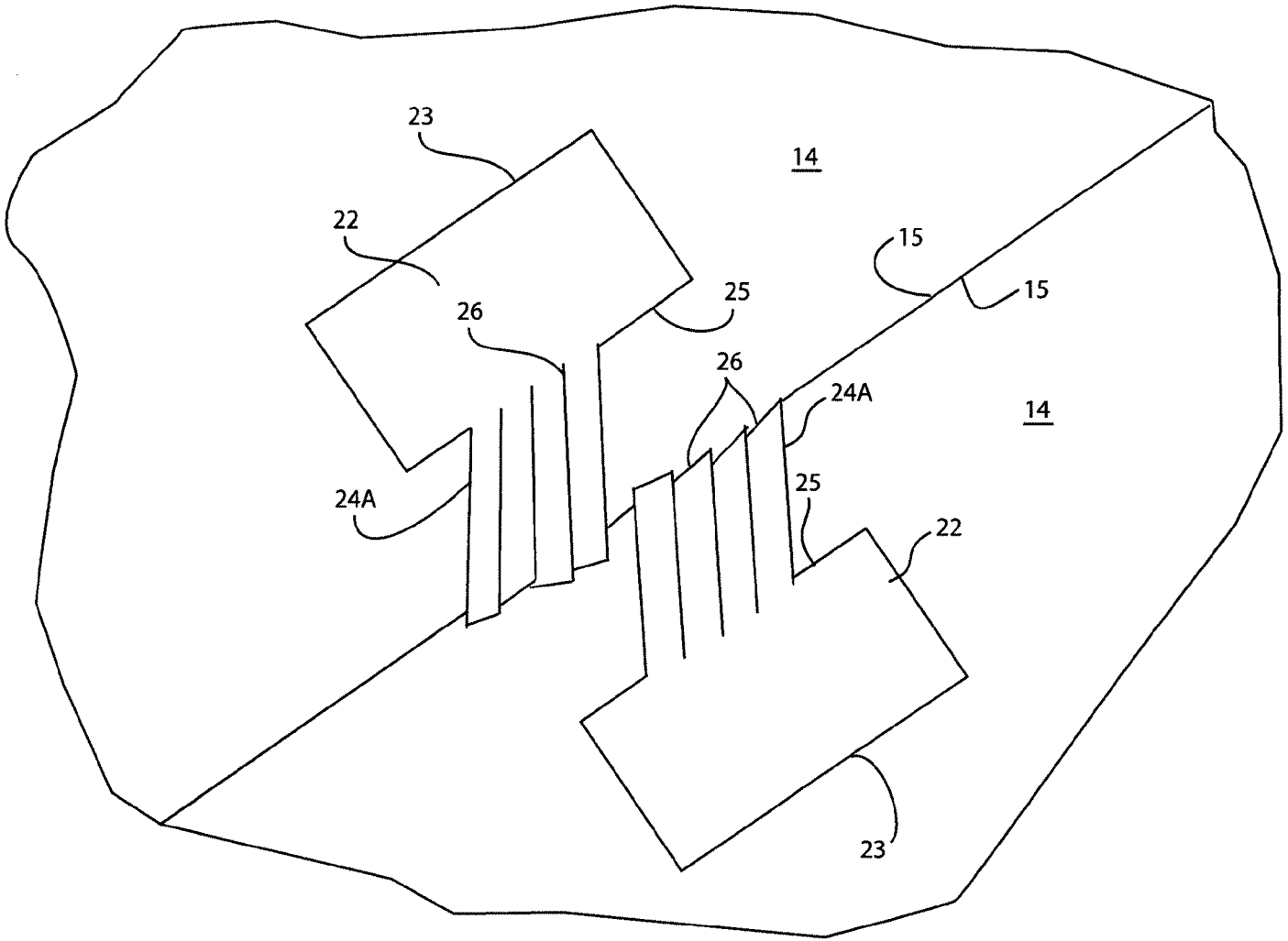
FIG. 4 is a view showing the position of the strips following severing as by cutting along the line of juncture between the edges of the opposing flaps.
Figure 6:
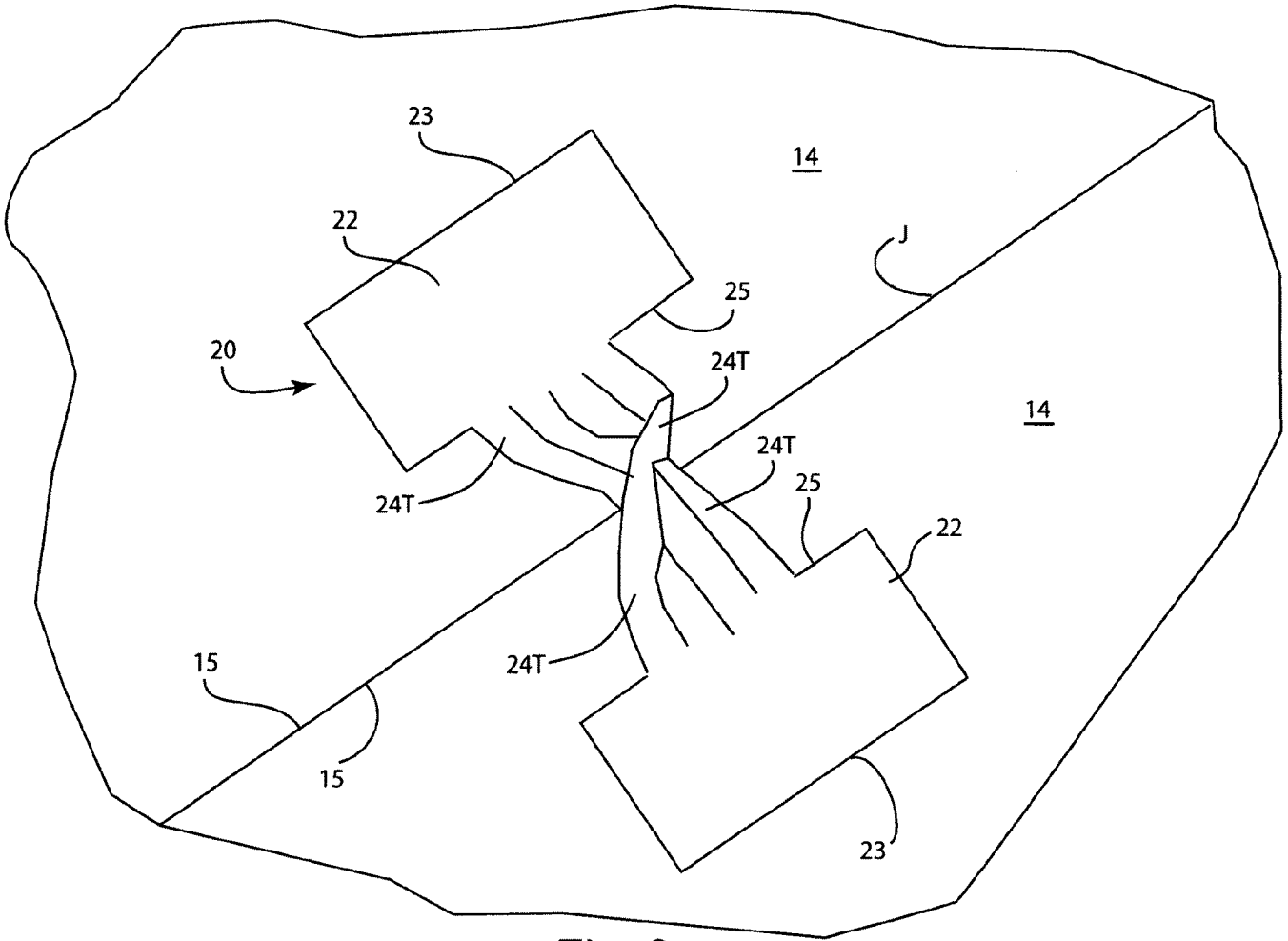
Figure 7:
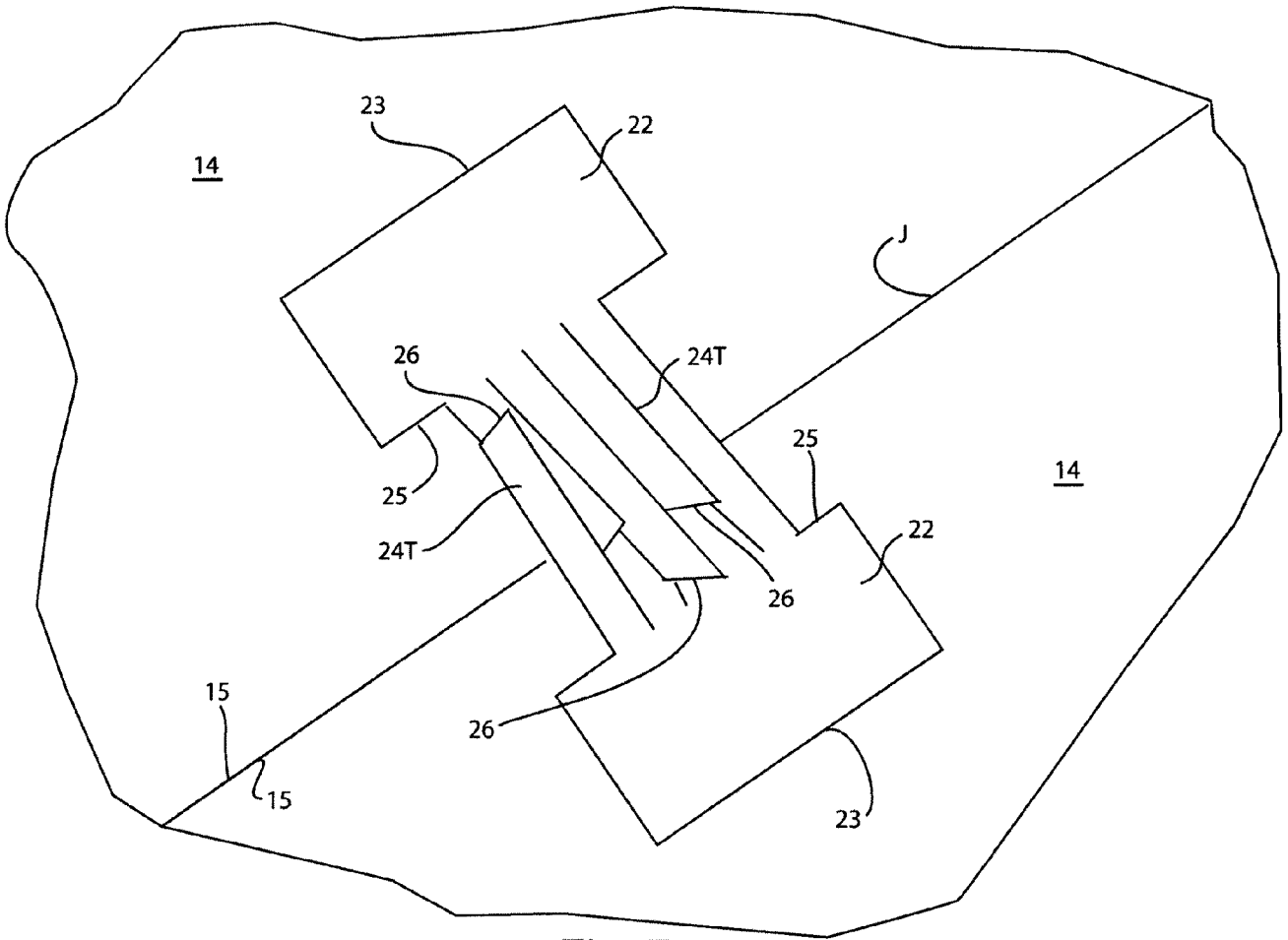
FIG. 7 shows the position of the opposing strips following cutting or otherwise severing by a party gaining unauthorized access to the carton.

Referring to FIG. 6, there is shown the steps of imparting stresses to the strips 24 extending between the pads 22 by a different manipulative mode than that shown in FIGS. 2-4. Under the procedure shown in FIG. 6, one pad 22 is initially, adhered to a flap 14 of the carton. When so adhered, the opposing pad 22 is gripped by a person or machine applying the label 20. With the first pad 22 so affixed, the opposing pad 22 is twisted 360 degrees and then affixed to the opposing flap 14 as shown in FIG. 6. As can be seen in FIG. 6 the strips have been identified as 24T to represent such twisting. Such twisting imparts stresses to the twisted strips 24T such that, upon severing by a person attempting to gain access to the carton C by cutting along the line of juncture J between the edges 15 of the flaps 14, the severed ends 26 of the severed strips 24T will be displaced from one another (see FIG. 7). The ends 26 of the severed strips 24T extending from one of the pads 22 will, as a result of the stresses built up during twisting, be in a different position than the ends 26 of the severed strips 24T extending from the first pad 22, thereby alerting users that the carton has been tampered with.

The stresses which are imparted to the strips 24 either upon moving one pad 22 laterally relative to an adhered pad 22 as shown in FIG. 2, or deformation to form convexities 28 and concavities 30 as shown in FIG. 3 or upon twisting as shown in FIG. 6 may be referred to as imparting a "spring-like" action to the strips 24. As will be appreciated, following such imparting of such "spring-like" action to the strips, both of the pads 22 are adhered to the opposing flaps 14; however, the strips 24 are not adhered. The pads 22 are preferably adhered to the respective flaps 14 by pressure sensitive adhesive well known in the art or any other type of conventional adhesive. The strips 24 may be deformed or twisted either mechanically or manually prior to the affixing of the second pad 22 to the flap 14.

For some applications it may be desirable to design the strips 24 so that they break easily, for example, when someone tries to rip open the flaps 14 of a carton by brute force without using a knife. For other applications, however, making the strips 24 more durable is preferred in order to prevent breaking due to abrasion or excessive wear during shipping and handling which could then create a false impression of tampering. The strips 24 and the entire label 20 can be reinforced with fiberglass or other reinforcement materials for added durability.

If desired, additional security features may be added to the label including holographic elements, serial numbers, taggants, hidden inks and the like. In addition to being attached to the flaps 14 by adhesive, the pads 22 could be attached by mechanical fasteners such as screws, pop rivets, staples, brads and the like.

The label may have any desired shape as long as it has a minimum of two anchoring pads and spring-loaded and/or twisted strips extending between the anchoring pads. Additionally, if desired, the tamper evident label 20 may be protected by a translucent or transparent overlay to protect the strips 24 from breaking as a result of accidental handling abuse.

Figure 8:
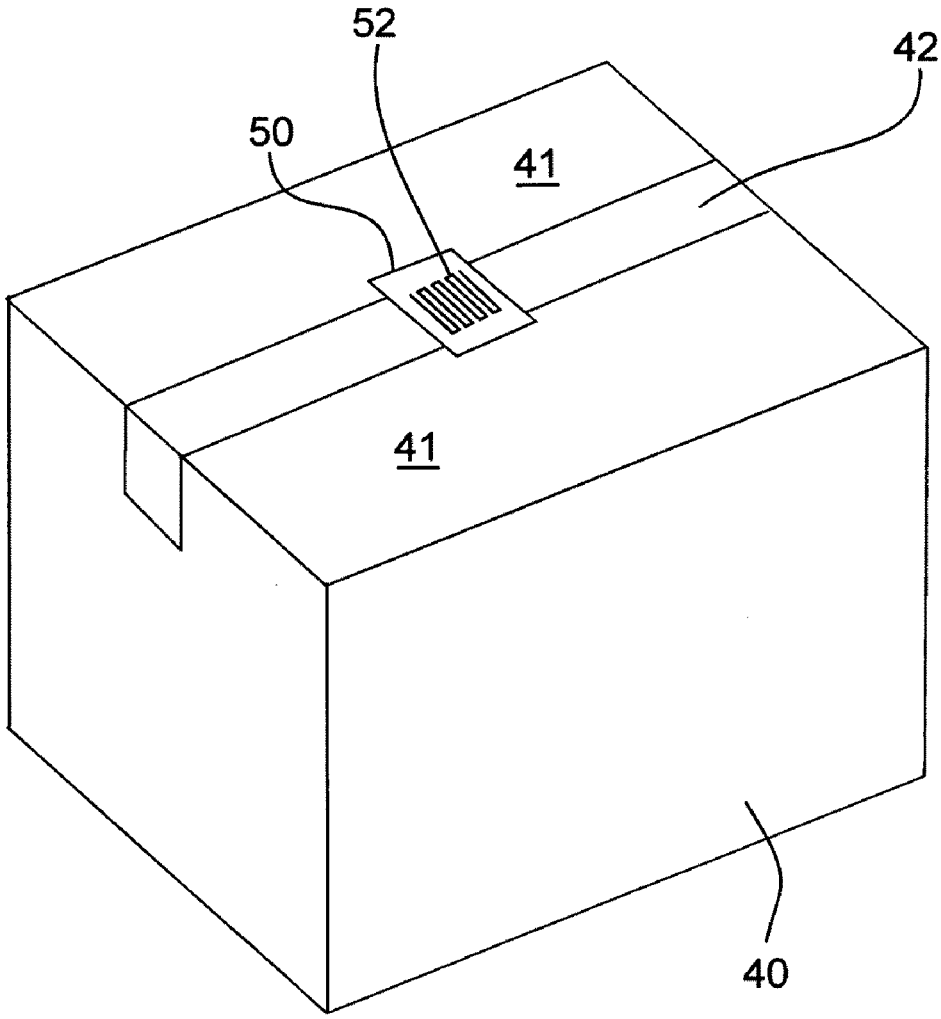
FIG. 8 is a perspective view of another embodiment showing a carton with flaps sealed by conventional sealing tape and overlaid with the tamper strip security seal of such embodiment.

Referring to FIG. 8, there is shown a carton 40 with a pair of flaps 41 sealed with carton sealing tape 42. Overlying the carton sealing tape 42 is the tamper strip security seal 50 of the present embodiment. As can be seen in FIG. 8, one end of the tamper strip security seal 50 is adhered to one flap and the opposing end is affixed to the other flap 41 such that security strips overlie the carton sealing tape 42 and the underlying joint between the flaps 41.

Figure 9:
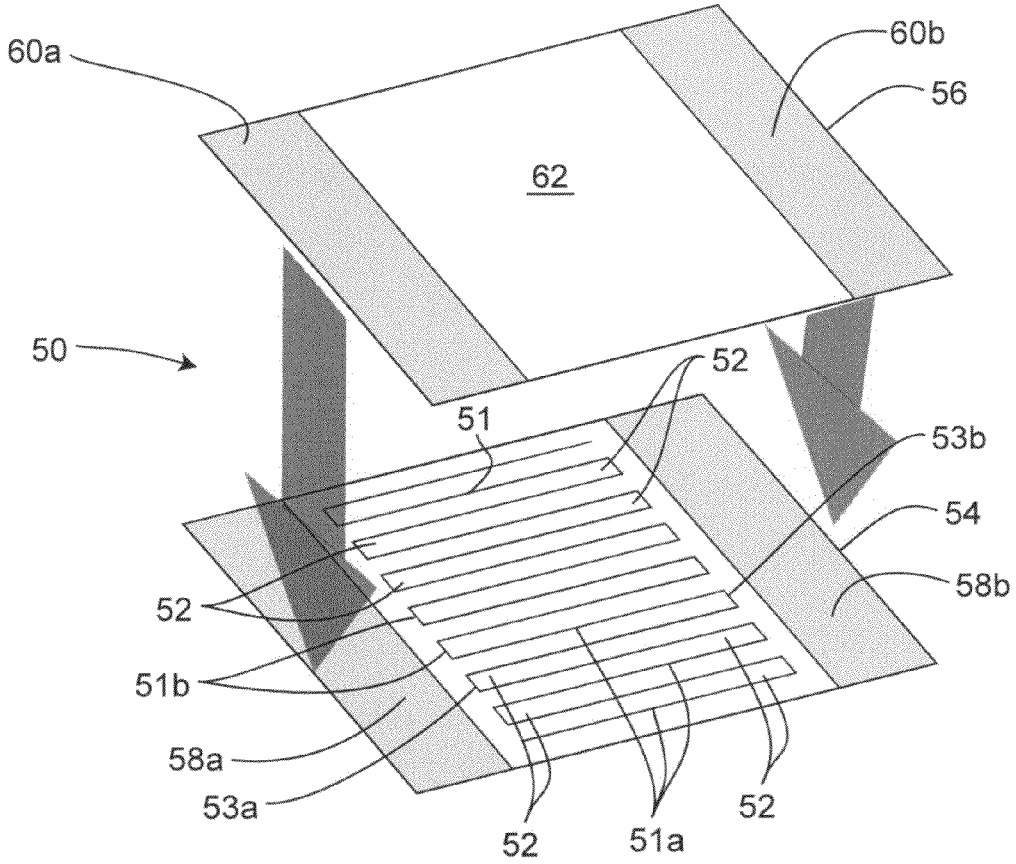
FIG. 9 is an exploded perspective view of the tamper strip security seal showing security label layer about to have a protective shield affixed thereto.

As may be seen from FIG. 9, the tamper strip security seal 50 comprises a lower security label member 54 and an upper protective shield 56. The security label 54 has a first end portion 58*a* and a second end portion 58*b* and is shown as being rectangular; however, other shapes are possible.

As can be seen, the central portion of the security label 54 has been die cut to form slits 51 extending longitudinally in a direction from said first end portion 58*a* toward said second end portions 58*b* and defining a plurality of tamper strips 52. It is not necessary that the slits 51 extend completely from the first end portion 58*a* to the second end portion 58*b*. As shown in FIG. 9 the tamper strips 52 may be formed by interconnected longitudinally extending slits 51*a* joined to one another by lateral slits 51*b*, with the longitudinally extending slits 51*a* forming the long edges of the tamper strips 52 and the lateral slits 51 forming the ends 53*a* and 53*b*. Thus, the interconnected slits 51*a* and 51*b* form a single slit defined by a plurality of S-shaped segments of alternating longitudinal and lateral slit segments. The tamper strips 52 do not have adhesive on either the lower or upper surface. In contrast the opposing end portions 58*a* and 58*b* have adhesive on the lower surface in order to permit such end portions it to be adhered to opposing flaps of a carton such as the flaps 41 shown in FIG. 8.

The protective shield 56 preferably is the same size as the security label 54 and is adhered thereto with adhesive on the lower surface of the end portions 60*a* and 60*b* thereof. As can be seen in FIG. 9 there is no adhesive on the central portion 62 of the protective shield 56. If desired, the end portions 58 of the security label 54 could also have adhesive on the upper surface in which case, the end portions 60*a* and 60*b* of the protective shield 56 would not need adhesive. In either event the protective shield 56 is adhered to the lower security label 54 at the ends 60*a* and 60*b* and not adhered at the central portion 62.

Figure 10:
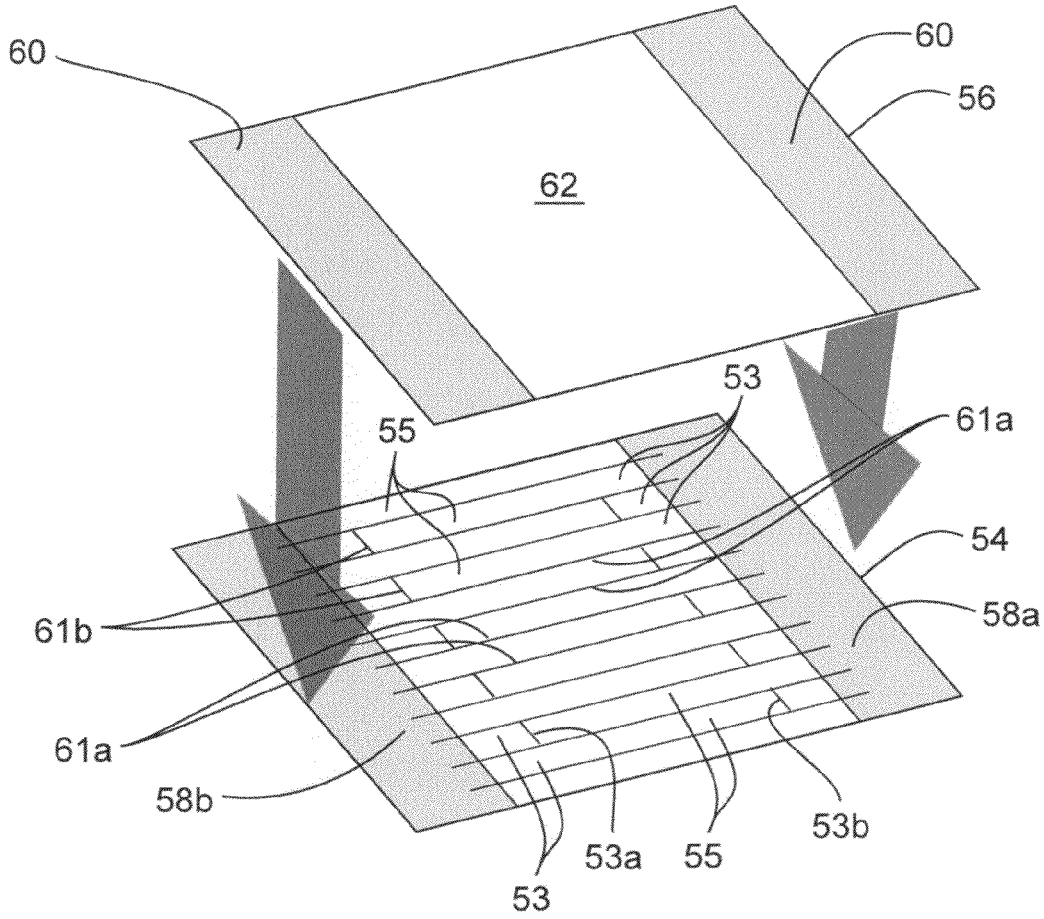
FIG. 10 is a view similar to FIG. 9 showing another embodiment with overlapping tamper strips on the security label layer.

FIG. 10 shows a modified tamper strip security seal. The only difference between the embodiment of FIG. 9 and that of FIG. 10 is that the security label 54 of FIG. 10 is cut to form a plurality of parallel longitudinal slits 61*a* and a plurality of lateral slits 61*b*, which lateral slits 61*b* are offset from one another longitudinally and cooperate to define tamper strips 53, alternating ones of which have ends 53*a* which are aligned with one another but which are offset from the ends 53*b* of adjacent tamper strips 53. As can be seen in FIG. 10, the ends 53*a* of those tamper strips 53 extending the longer distance from end portion 58*a* extend beyond the ends 53*b* of those tamper strips 53 extending the longer distance from end portion 58*b*. As a result, there is provided an overlap area 55 which will overlie the joint between the flaps 41 of a carton 40 and will, therefore be cut upon the slitting by a knife along such joint.

Figure 11:
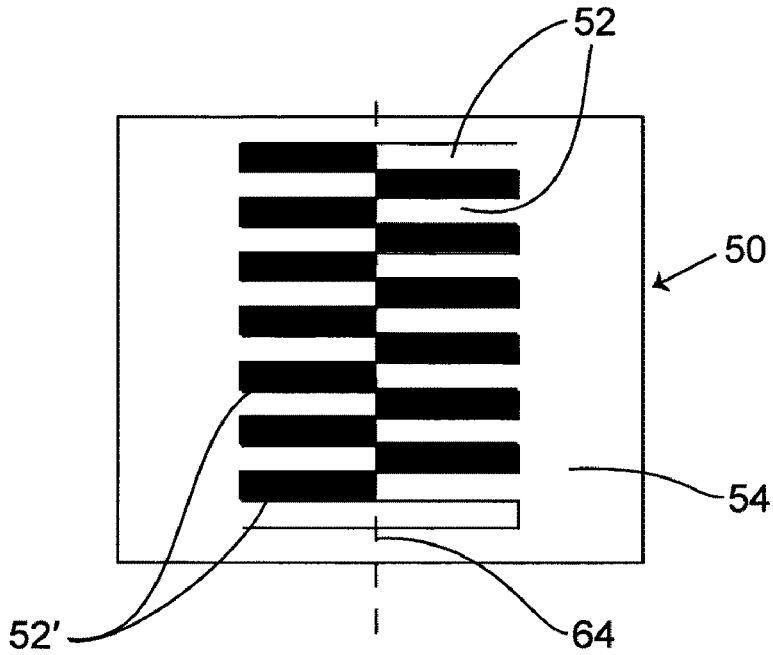
FIG. 11 is a plan view of the tamper strip security seal of FIG. 9 after slitting.

FIG. 11 shows the tamper strip security seal 50 of FIG. 9 after slitting to form a knife cut 64. As can be seen in FIG. 11, the sections identified by the numeral 52' and shown in black illustrate displaced or missing sections from the portions of the tamper strips 52 still connected to the security label 54

(shown in white), thus providing a clear and readily observable indication that tampering has occurred.

A similar knife cut along a joint of a carton to which the tamper strip security seal of the embodiment of FIG. 10 will likewise result in the displacement or missing portions of the overlapped areas 55 of tamper strips 53.

Figure 12:
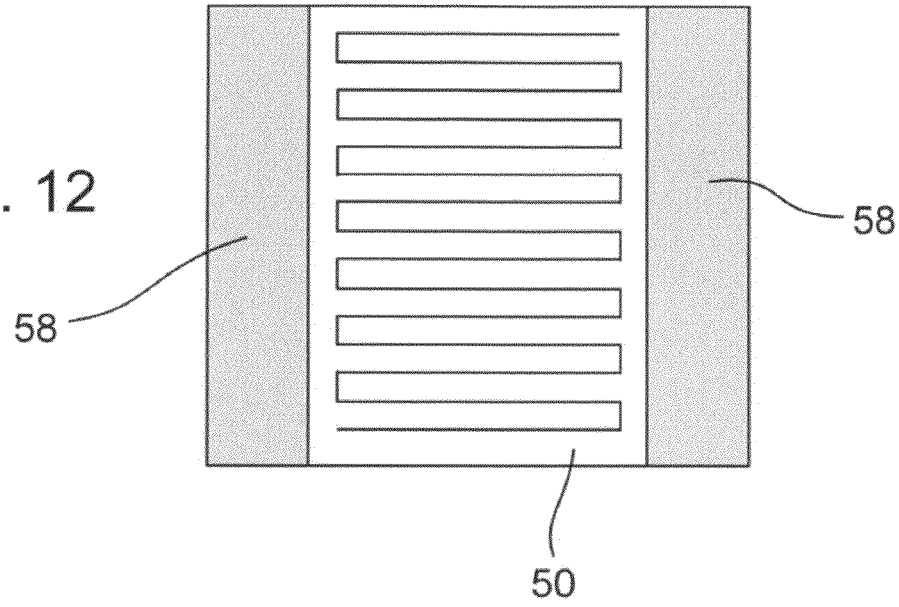
FIG. 12 is a plan view of another embodiment of the tamper strip security seal before its removal from a carton.
Figure 13:
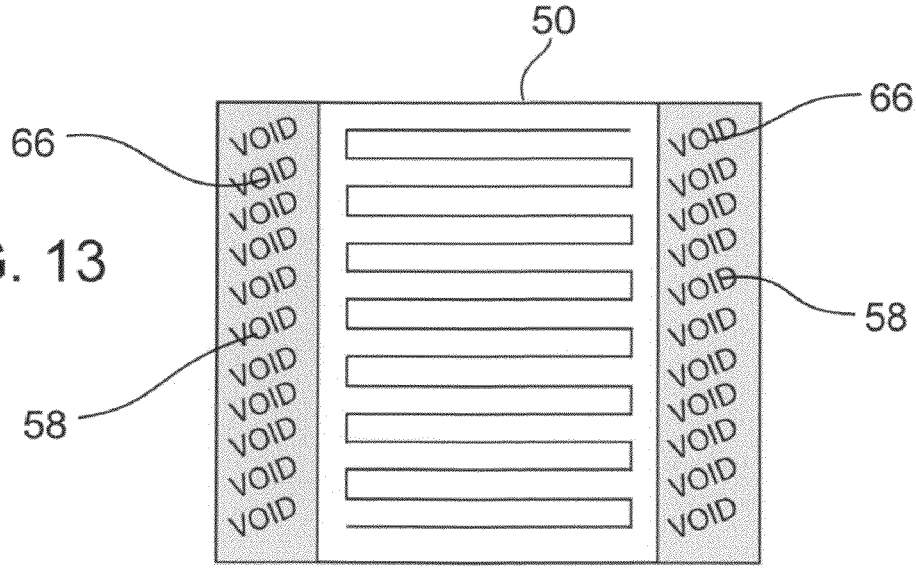
FIG. 13 is a view similar to FIG. 12 but showing the tamper strip security seal after its removal from a carton.

FIGS. 12 and 13 show an added embodiment in which a tamper evident pattern of graphics or text such as the word VOID 66 has been integrated with the adhesive backing at the security label end portions 58 intended to face the carton flaps 41. As can be seen in FIG. 12 the tamper evident pattern cannot be seen when the tamper strip security seal 50 is affixed to the flaps 41 as such tamper evident pattern will be covered by the adhesive. However, as shown in FIG. 13, if the tamper strip security seal 50 is removed from the carton flaps, residue of such tamper evident pattern 66 will remain visible on the flaps 41 as well as the removed tamper strip security seal.

Figure 14:
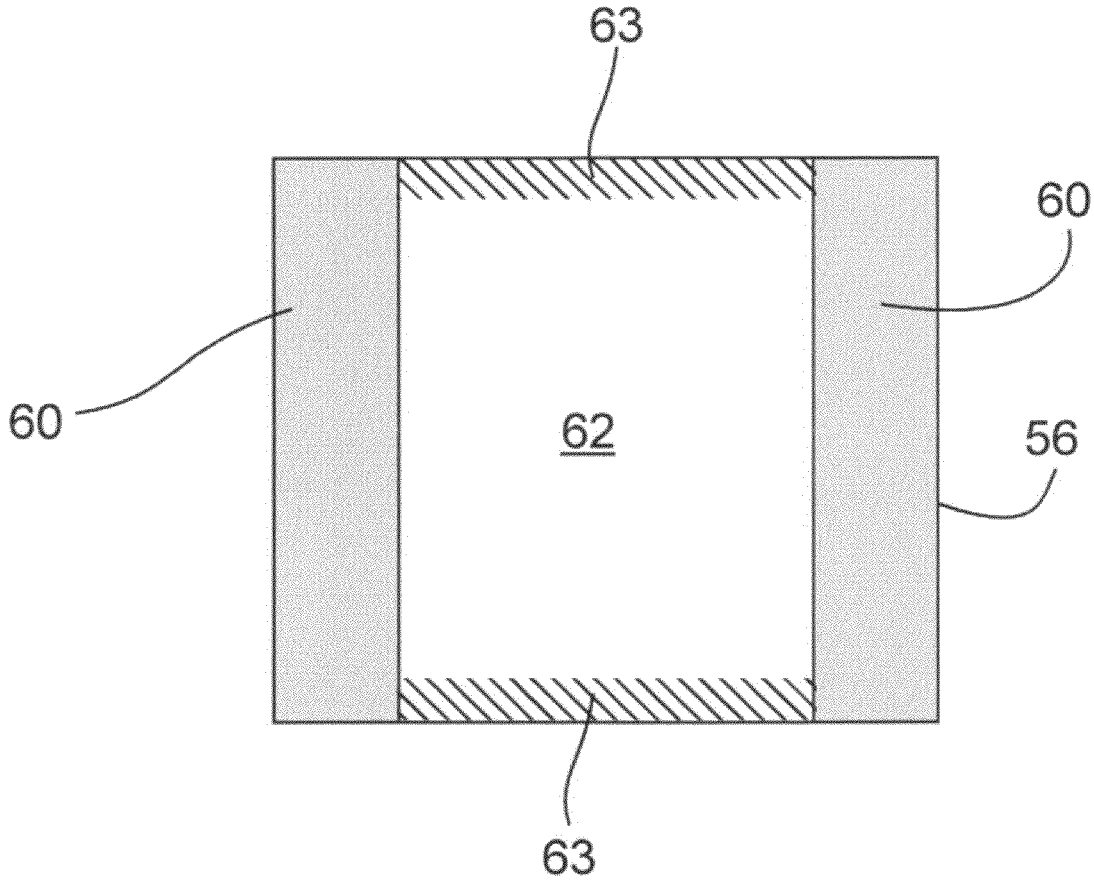
FIG. 14 is a plan view of a modified protective shield which is affixed to the security label layer.

FIG. 14 shows an embodiment in which the protective shield 56, in addition to having adhesive at the end portions 60, has adhesive along edges 63 extending between end portions 60 but not in the central portion 62 which will overlie the tamper strips 52.

Figure 15A:
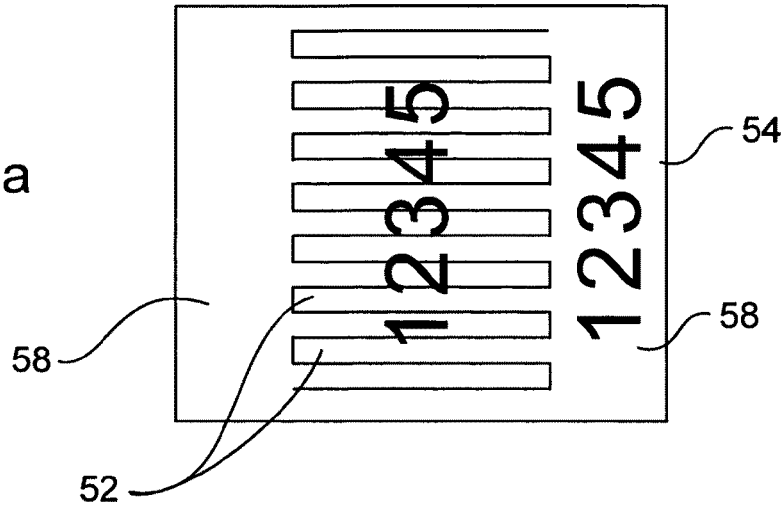
FIG. 15*a* is a plan view showing a tamper strip security seal having numbers imprinted in two places, namely, on the tamper strips themselves and on an edge portion spaced from the tamper strips.
Figure 15B:
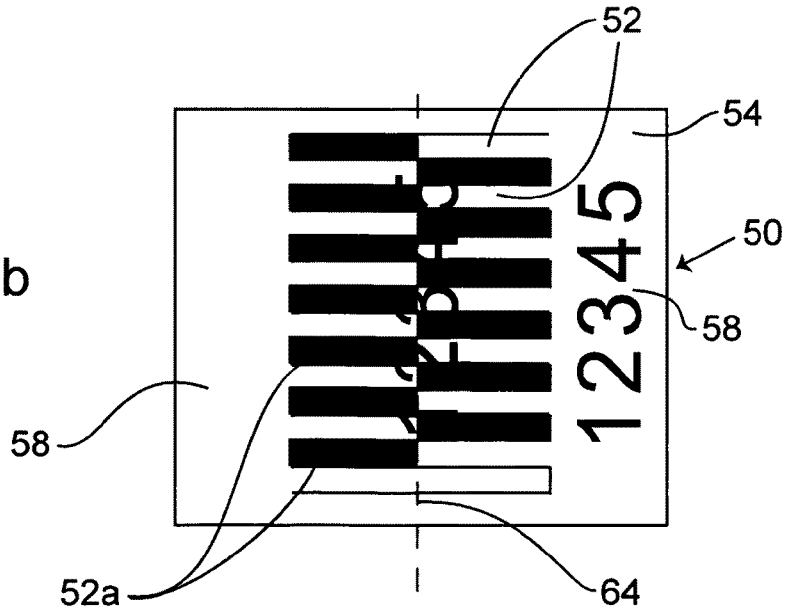
FIG. 15*b* is a view showing the tamper strip security seal of FIG. 15*a* after slitting.

FIGS. 15*a* and 15*b* show a modified embodiment in which numbers such as "12345" are applied to one or both of the end portions 58 of the security label 54 and to the tamper strips 52. As can be readily seen in FIG. 15*b*, a knife cut 64 through the tamper strips 52 will cause a shifting or complete absence of those portions of the tamper strips 52*a* which are unconnected to the end portions 58, thereby disrupting and rendering unreadable those numbers printed on the tamper strips 52.

Figure 16:
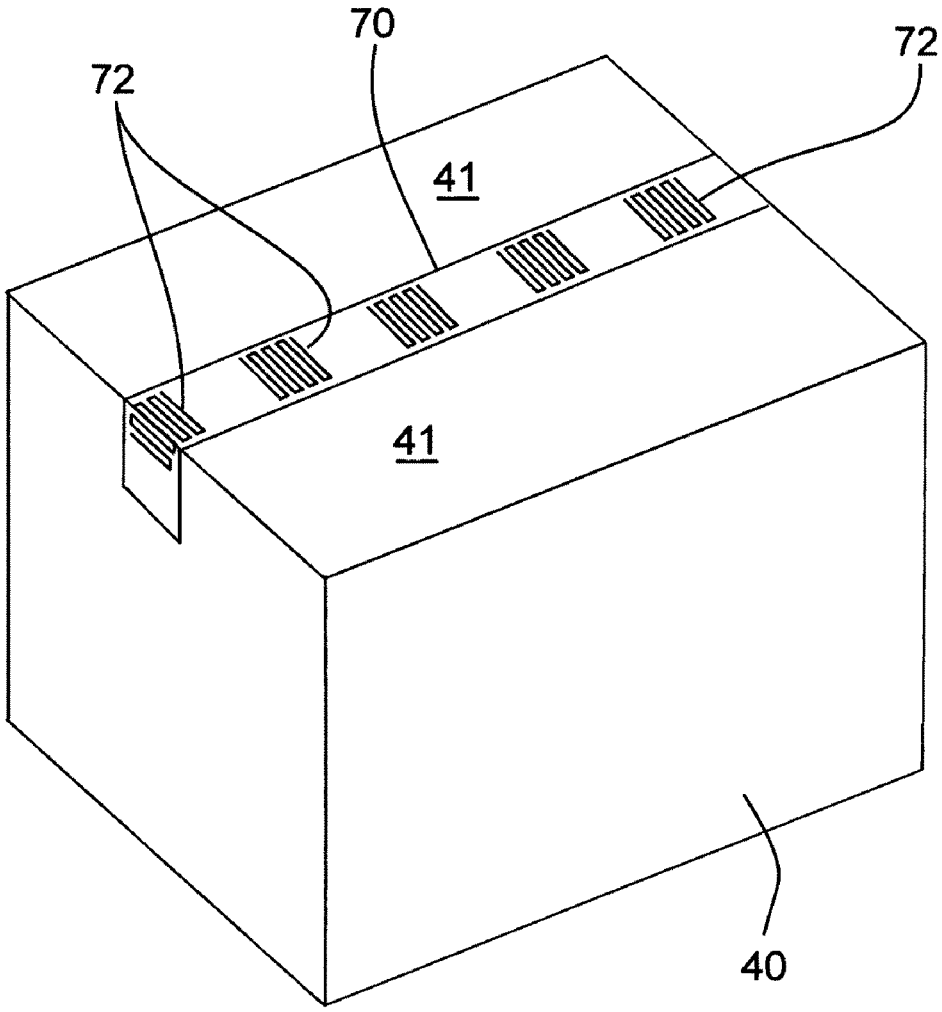
FIG. 16 is a view of a modified embodiment showing a tamper strip security tape.

FIG. 16 shows an additional embodiment in which there is provided a tamper strip security tape 70. The tape 70 is shown as being affixed to opposing flaps 41 of a carton 40 to overlie the joint or seam between such flaps. The tamper strip security tape 70 is provided with a plurality of tamper strip sections 72 each of which has tamper strips similar to the tamper strips 52 of the security label 54. There is no adhesive on either surface of the tamper strip security sections 72. All other portions of the tamper strip security tape 70 may be provided with adhesive for fastening to the carton 40 and its flaps 41. The tamper strip security tape 70 may also have a protective shield adhered thereto and overlying, but not adhered to the tamper strip sections 72.

Figure 17A:
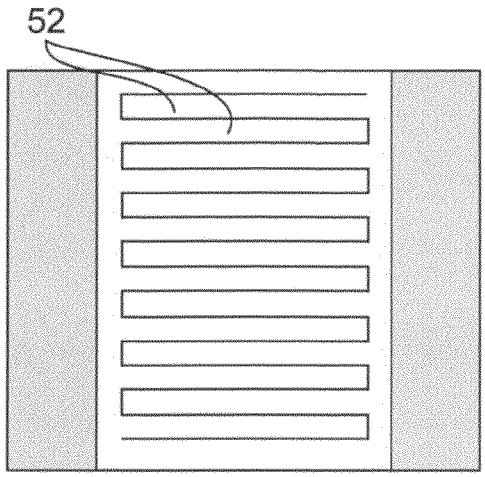
FIGS. 17*a*, 17*b* and 17*c* are views of the tamper strip security seal showing a variety of die cuts to form tamper strips of varying configurations.
Figure 17B:
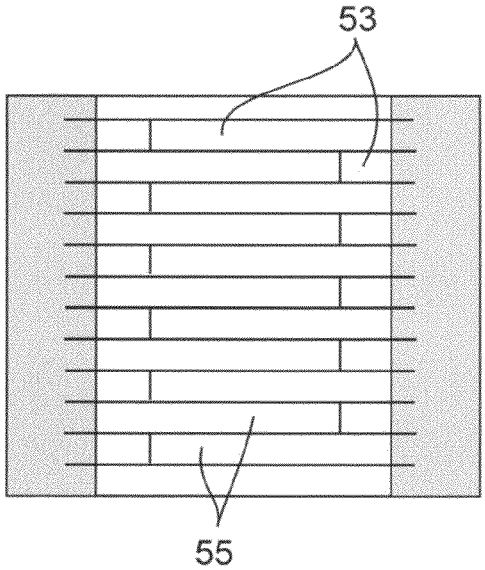
Figure 17C:
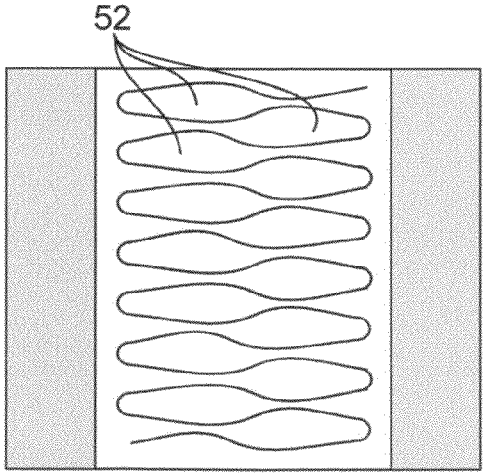

FIGS. 17*a*, 17*b* and 17*c* show variations of die cut configurations which may be used in forming various shapes the tamper strips 52, 53.

Figure 18A:
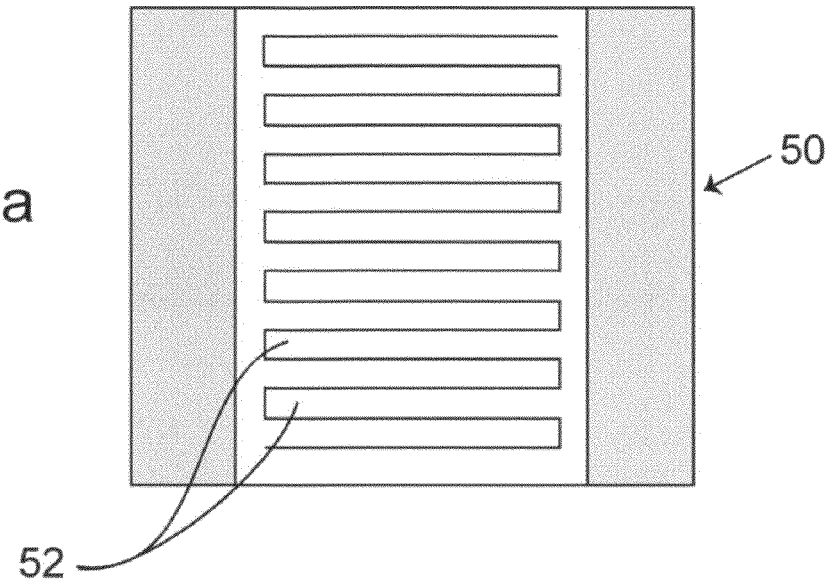
FIGS. 18*a* and 18*b* are views of an embodiment of tamper strip security seal showing hidden messages printed under the strips which are revealed following slitting.
Figure 18B:
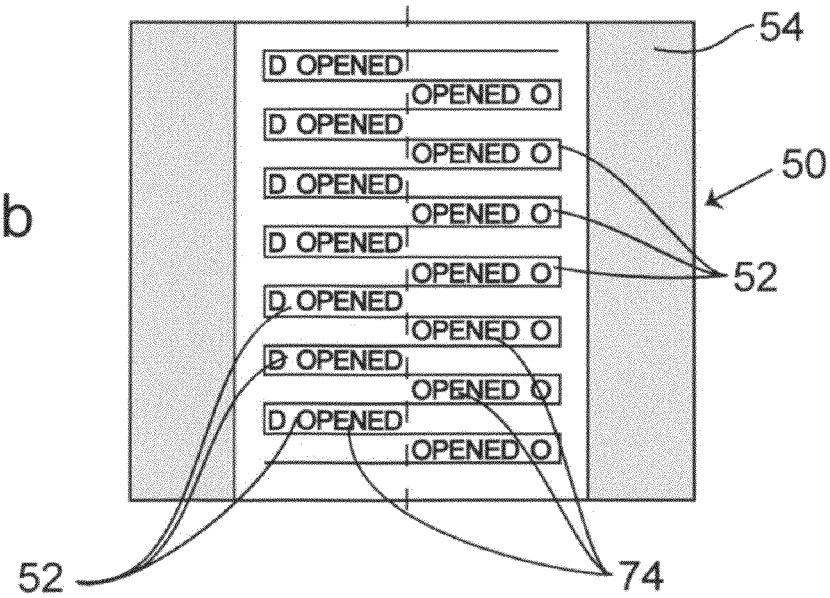

FIGS. 18*a* and 18*b* show another embodiment in which the tamper strip security seal 50 is provided with an underlay having printing 74 which will become visible upon slitting as a result of portions of the tamper strips 52 being displaced or missing, with the result that the printing 74 such as with the word "OPENED" becomes visible.

In summary, the present invention is directed a security label having a feature that shows tampering when the label is slit by a knife or razor. The label is typically placed on the opposing flaps of a shipping carton.

Under the embodiment of FIGS. 9-18, it is constructed in two layers, a bottom security label layer which contains a plurality of tamper strips and a top layer, which is a clear shield to protect the strips during shipping and handing (see FIG. 9). These two pieces are bonded together to make a unitized construction.

The tamper indicating feature, namely, the tamper strips, may be created in the bottom security label layer with a special continuous die cut forming a continuous slit 51 (see FIG. 9). However, as shown in FIG. 10, it is not necessary that the die cut forming the slits 61*a* and 61*b* be continuous. The tamper strip portion of the security label layer does not have adhesive backing, so that the loose ends of the tamper strips will separate and be displaced or fall out of alignment when slit (see FIG. 11).

The security label has adhesive backing under both ends outside of the tamper strip area. The ends of the security label may also have a tamper evident hidden release pattern. After being affixed to the carton, if the security label is removed, the hidden pattern (VOID, OPENED, etc.) will be revealed (FIG. 13) in the security label and leave a similar pattern on the carton.

The label has a protective shield (clear or translucent) over the top to protect the tamper strips from accidental handling abuse during shipping. The center section of the shield, located directly above the tamper strips, does not have any adhesive backing. As an option, a patterned adhesive may be used along the edges spaced from the tamper strips. This adhesive pattern can be applied to the security label and/or the protective shield.

For added security, all or a portion of the security label layer and/or protective shield may include one or more anti-counterfeiting technologies, such as holograms, UV fluorescent inks, infrared inks, taggants, color-shifting inks, diffractive foils, etc. In addition, electronic article surveillance technologies such as radio frequency, acoustic, electromagnetic, etc. may be used.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. In combination (a) a carton or other container having first and second opposing flaps movable to a closed position, said flaps each having an edge, the edges being movable toward one another when said flaps are moved to the closed position, one or both of said edges defining a joint; and (b) a tamper-evident label comprising a first pad fastened to said first flap, a second pad fastened to said second flap and at least one strip joining said first and second pads, said at least one strip overlying said joint but not fastened to said flaps and being in a stressed condition such that, upon cutting or breaking said at least one strip to form strip ends, said strip ends extending from said first pad will be displaced from the strip ends extending from said second pad:

wherein said at least one strip is placed in a stressed condition by moving said first pad relative for said second pad.

2. In combination (a) a carton or other container having first and second opposing flaps movable to a closed position, said flaps each having an edge, the edges being movable toward one another when said flaps are moved to the closed position, one or both of said edges defining a joint; and (b) a tamper-evident label comprising a first pad fastened to said first flap, a second pad fastened to said second flap and at least one strip joining said first and second pads, said at least one strip overlying said joint but not fastened to said flaps and being in a stressed condition such that, upon cutting or breaking said at least one strip to form strip ends, said strip ends extending from said first pad will be displaced from the strip ends extending from said second pad;

wherein upon fastening said first pad to said first flap and prior to fastening said second pad to said second flap, said at least one strip is disposed at an angle to said joint other than perpendicular, said stressed condition being imparted by displacing said second pad to a position at which said at least one strip is substantially perpendicular to said joint upon fastening said second pad to said second flap.

3. In combination (a) a carton or other container having first and second opposing flaps movable to a closed position, said flaps each having an edge, the edges being movable toward one another when said flaps are moved to the closed position, one or both of said edges defining a joint; and (b) a tamper-evident label comprising a first pad fastened to said first flap, a second pad fastened to said second flap and at least one strip joining said first and second pads, said at least one strip overlying said joint but not fastened to said flaps and being in a stressed condition such that, upon cutting or breaking said at least one strip to form strip ends, said strip ends extending from said first pad will be displaced from the strip ends extending from said second pad;

wherein said at least one strip is placed in said stressed condition prior to said second pad being joined to the said second flap by being deformed (1) from a position lying in a plane (2) to a position defining a concavity and a convexity in a direction from said first pad to said second pad.

4. In combination (a) a carton or other container having first and second opposing flaps movable to a closed position, said flaps each having an edge, the edges being movable toward one another when said flaps are moved to the closed position, one or both of said edges defining a joint; and (b) a tamper-evident label comprising a first pad fastened to said first flap, a second pad fastened to said second flap and at least one strip joining said first and second pads, said at least one strip overlying said joint but not fastened to said flaps and being in a stressed condition such that, upon cutting or breaking said at least one strip to form strip ends, said strip ends extending from said first pad will be displaced from the strip ends extending from said second pad;

wherein said are at least one strip is twisted prior to said second pad being joined to said second flap.

5. A tamper evident label comprising a security layer having a first end portion for fastening to one flap of a carton or other container, a second end portion for fastening to a second flap of a carton or other container and a central portion between said first and second end portions, said central portion having no means for fastening to said first flap or said second flap and having a plurality of slits defining tamper strips, said tamper strips, upon being cut or broken form strip ends, will have the strip ends extending from said first end portion displaced from the strip ends extending from said second end portion; and a protective shield overlying said security layer, said protective shield being adhered to said first end portion and to said second end portion but not adhered to said central portion.

6. A tamper evident label according to claim 5 wherein the side of said security layer first end portion or said second end portion intended to be affixed to a flap of said carton or other container has printing, a portion of which will remain on the flap when said first end portion or said second end portion is removed therefrom.

7. A tamper evident label according to claim 5 wherein indicia is printed on said strips in an area overlying said joint.

8. A tamper evident label according to claim 7 wherein said indicia is also printed on at least one of said end portions.

9. In combination:

(a) a carton or other container having a first and second opposing flaps movable to a closed position, said flaps each having an edge, the edges being movable toward one another when said flaps are moved to the closed position and, when closed, one or both of said edges define a joint; and a tamper evident label comprising a security layer having a first end portion fastened to said first flap, a second end portion fastened to said second flap and a central portion between said first and second end portions, said central portion (i) overlying said joint but not fastened to said first flap or said second flap and (ii) having a plurality of slits defining tamper strips, said tamper strips being in a stressed condition such that, upon being cut or broken to form strip ends, will have the strip ends extending from said first end portion displaced from the strip ends extending from said second end portion;

wherein said tamper strips are placed in a stressed condition by moving said first end portion relative to said second end portion.

10. The combination according to claim 9 further including a protective shield overlying said security layer, said protective shield being adhered to said first end portion and to said second end portion but not adhered to said central portion.

11. The combination according to claim 9 wherein the side of said security layer first end portion or said second end portion affixed to said first flap or said second flap has printing, a portion of which will remain on the flap when said first end portion or said second end portion is removed therefrom.

12. The combination according to claim 9 wherein indicia is printed on said strips in an area overlying said joint.

13. The combination according to claim 12 wherein indicia is also printed on at least one of said security layer end portions.

14. In combination:

(a) a carton or other container having one flap or first and second opposing flaps movable to a closed position, said flaps each having an edge, the edges being movable toward one another when said flaps are moved to the closed position and, when closed, one or both of said edges define a joint;

(b) a security tape overlying said joint and having portions thereof adhered to said flaps, said security tape having at least one tamper strip section, said at least one tamper strip section comprising a security layer having a first end portion fastened to said first flap of said carton or other container, a second end portion fastened to said second flap and a central portion between said first and second end portions, said central portion overlying said joint but not fastened to said first flap or said second flap and having a plurality of slits extending longitudinally at least part way between said first end portion and said second end portion: said slits defining said at least one tamper strip which upon being cut or broken will form strip ends which will be displaced from one another; and (c) a protective shield overlying said security layer, said protective shield being adhered to said first end portion and to said second end portion but not adhered to said central portion.

15. In combination:

(a) a carton or other container having a first and second opposing flaps movable to a closed position, said flaps each having an edge, the edges being movable toward one another when said flaps are moved to the closed position and, when closed, one or both of said edges define a joint; and (b) a tamper evident label comprising a security layer having a first end portion fastened to said first flap, a second end portion for fastened to said second flap and a central portion between said first and second end portions, said central portion overlying said joint but not fastened to said first flap or said second flap and having a plurality of slits defining tamper strips, said tamper strips, upon being cut or broken to form strip ends, will have the strip ends extending from first end portion displaced from the strip ends extending from said second end portion; and (c) protective shield overlying said security layer, said protective shield being adhered to said first end portion and to said second portion but not adhered to said central position.

16. The combination according to claim 15 wherein the side of said security layer first end portion or said second end portion intended to be affixed to a flap of said carton or other container has printing, a portion of which will remain on the flap when said first end portion or said second end portion is removed therefrom.

17. The combination according to claim 15 wherein indicia is printed on said strips in an area overlying said joint.

18. The combination according to claim 17 wherein indicia is also printed on at least one of said security layer end portions.

* * * * *